United States Patent [19]

Lo et al.

[11] 4,047,646

[45] Sept. 13, 1977

[54] CHILD-SAFE AEROSOL ACTUATOR

[75] Inventors: Mei-Kuo Lo; Erwin Sheppard, both of Racine, Wis.

[73] Assignee: S. C. Johnson & Son, Inc., Racine, Wis.

[21] Appl. No.: 597,856

[22] Filed: July 21, 1975

[51] Int. Cl.[2] ..... B65D 83/14; B65D 55/02

[52] U.S. Cl. ..... 222/402.13; 215/202

[58] Field of Search ..... 222/402.1, 402.11, 402.13; 215/9, 202; 218/202

[56] References Cited

U.S. PATENT DOCUMENTS

| | | | |
|---|---|---|---|
| 3,058,626 | 10/1962 | Hibbs et al. | 222/402.13 X |
| 3,180,531 | 4/1965 | Beard et al. | 222/402.13 X |
| 3,405,827 | 10/1968 | Garden | 215/202 |
| Re. 26,367 | 4/1968 | Sagarin | 222/402.13 X |

*Primary Examiner*—Robert B. Reeves
*Assistant Examiner*—Frederick R. Handren

[57] ABSTRACT

A device for use with pressurized dispensers adapted to prevent valve actuation by human fingers of less than predetermined dimensions. The device is characterized by an actuator member having an upper surface with effective and ineffective areas. The effective area is non-depressible by fingers of less than a predetermined dimension and the ineffective area has finger-repelling means thereon. The invention may be incorporated in an independent actuator button or in an actuator-over-cap.

27 Claims, 8 Drawing Figures

CHILD-SAFE AEROSOL ACTUATOR

BACKGROUND OF THE INVENTION

This invention relates generally to the field of pressurized dispensing and in particular to actuator devices for finger actuation of dispensing apparatus associated with aerosol containers.

During recent years pressure packaging has developed into one of the most popular forms of packaging for fluid products. Such packages, which have become known as aerosols, have tremendous advantages in convenience and ease of application. Their popularity is evidenced by the fact that many billions of aerosols are used each year.

Although aerosol packaging in general has shown itself to be one of the safest forms of packaging, efforts are continually being made to improve product safety; it can be demonstrated that the safety of aerosol devices has improved greatly in recent years. One aspect of the safety effort has been an attempt to render the contents of aerosol containers inaccessible to children of tender years. Aerosol devices which accomplish this have been given the designation "child-safe" and many devices suitable for this purpose have been developed. See U.S. Pat. Nos. 3,712,515, 3,768,968, 3,622,052, 3,610,475, 3,706,401, 3,729,120, 3,770,167 and 3,722,748.

One problem with many of these devices is that after product use the device does not return itself to a child-safe condition; a separate intentional action on the part of the user is required to render the device child-safe. Another problem with many devices is complexity of structure and operation which make the device difficult to operate or expensive to manufacture. There has been a need for an aerosol actuating device which returns itself to a child-safe condition after use without human intervention and is simple in operation and economical in construction.

One approach to the problem of developing child-safe containers has been to make use of the normal differences in finger dimensions between adults and children of tender years. It is well known that adults have longer and wider fingers than young children. Various efforts have been made to utilize these differences in the past as evidenced by U.S. Pat. Nos. 3,712,515 and 3,786,968.

Corrl Pat. No. 3,812,515 utilizes the difference in finger length between an adult and a child to render an aerosol actuating button inaccessible to a child of tender years. The device includes a tunnel having an actuator button at one end and an open end at the other end. Only a finger greater than a predetermined length can reach the button. The Corrl overcap has some disadvantages. First, its shape is non-concentric with respect to the container with which it is used, which has the potential for problems in package assembly, packing for shipment, and in placement on store shelves. An additional problem is that a finger can become entrapped in the tunnel when one person is taking the product from another, leading to possible broken fingers. Ewald U.S. Pat. No. 3,786,968 utilizes the difference in finger widths of children and adults. An adult finger is wide enough to spread laterally movable disabling members adjacent an actuator button thereby freeing the button for actuating depression, while a narrow finger would fail to spread the disabling members. The Ewald device, while having an automatic locking capability, has shown itself to be difficult to understand and operate.

Furthermore, its construction is complex and is believed to be expensive.

BRIEF DESCRIPTION OF THE INVENTION

The device of this invention requires no human intervention to achieve a child-safe condition after use. Furthermore, the device of this invention is free of the aforementioned problems. It is neither complex nor expensive in construction and its operation is readily understood. The inventive device is characterized by an actuator member having an upper surface with separate areas either effective or ineffective for actuation of the aerosol valve with which the invention is used. The effective area is non-depressible by fingers of less than predetermined dimensions. In all embodiments, the ineffective area has finger-repelling means thereon to prevent or discourage effective application of downward pressure by a human finger.

OBJECTS OF THE INVENTION

One object of this invention is to provide a child-safe device, for use with pressurized dispensers which is rendered child-safe after use without human intervention.

Another object of this invention is to provide a child-safe device which is economical to manufacture.

Another object of this invention is to provide a child-safe device for pressurized dispensers which is simple in operation and is readily understood by adults.

Yet another object of this invention is to provide a child-safe actuating device for pressurized dispensers having no more moving parts than are included in standard aerosol actuating devices.

BRIEF DESCRIPTION OF THE DRAWINGS

These and other objects of the invention will be apparent from the following description of preferred embodiments wherein.

DETAILED DESCRIPTION OF PREFERRED EMBODIMENTS

Figure 1:
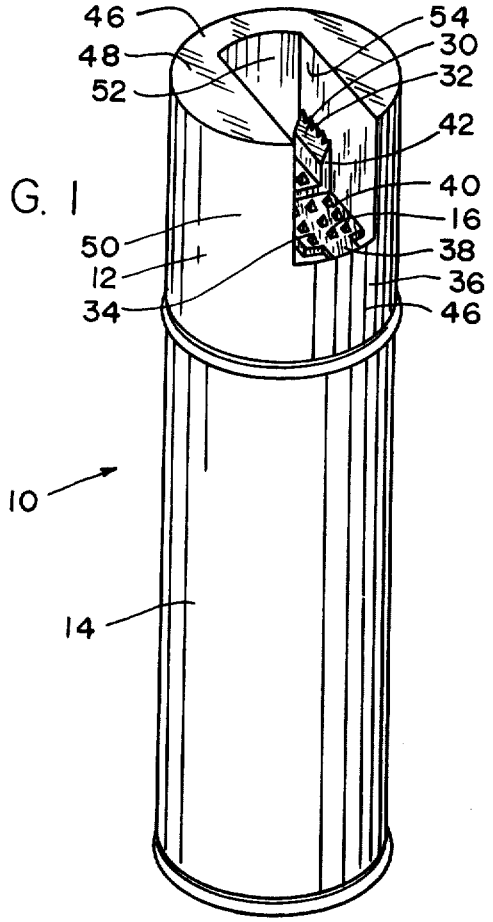
FIG. 1 is a full perspective view of an aerosol container having an actuator-overcap including a child-safe device according to this invention.

As shown in FIGS. 1 and 3–8, aerosol package 10 has an actuator-overcap 12 attached to pressurized container 14. In each case actuator-overcap 12 has an actuator member 16 connected to a valve stem 18 which protrudes from a valve 20 connected to an upper portion 22 of pressurized container 14. In FIG. 2, however, an actuator member 24 is attached to valve stem 18 and is independent of any other supporting structure.

Referring to the embodiment of FIG. 2, actuator member or button 24 defines therein a fluid passage (not shown) terminating in an exit orifice (not shown), as is standard in independent valve mounted buttons on aerosol containers. Button 24 has a top surface 26 on which are fixed two standing members 28. Standing members 28 are spaced apart by a predetermined width which is greater than the normal width of a finger of a child of tender years. Standing members 28 have facing, substantially mirror image inclined surfaces 30 which terminate upwardly in finger-repelling edges 32 which are formed into toothed edges. Toothed edges 32 are configured such that downward pressure sufficient to depress valve stem 18, to actuate the valve and dispense the product within container 14, could not be applied by a finger without causing excessive discomfort thereto. Inclined surfaces 30 are at an angle with respect to the axis of stem 18 (which forms the direction of movement) such that axial depression on only one of the inclined surfaces 30 would result in the sliding of the finger therefrom, thereby rendering such action ineffective to actuate the valve. Between standing members 28 pointed members 34 are arranged on and affixed to top surface 26 and serve as finger-repelling means such that sufficient actuating pressure could not be applied by contact therewith without causing discomfort to the finger.

A single finger can comfortably apply actuating pressure to button 24 only if the finger width is greater than the predetermined spacing between standing members 28 such that it would be cradled on both of the inclined surfaces 30 as downward pressure is applied. Button 24 in FIG. 2 has an upper surface consisting of both inclined surfaces 30, both finger-repelling edges 32, and top surface 26 between standing members 28. The upper surface of button 26 has areas ineffective for valve actuation, including the portion of top surface 26 between standing members 28, the finger-repelling edges 32, and either of the inclined surfaces 30 alone. However, inclined surfaces 30 together form an area of the upper surface which is effective for dispensing actuation, by a finger of adult width.

Button 24 is a single piece molded in plastic. Materials which may be used to make button 24 would be well known to those skilled in the art who are made aware of this invention. Materials commonly used in actuator buttons for aerosol containers may be used.

In each of the embodiments illustrated in FIGS. 1 and 3–8, an actuator member 16 is hinged by a hinge 38 to a surrounding overcap structure 36 which is attached to container 14 in known manner. Actuator member 16 has a base 39 forming an extender portion 40 adjacent hinge 38 and an operational portion 42 remote from hinge 38. Operational portion 42 in each of the embodiments shown in FIGS. 1 and 3–5 is similar to button 24 of FIG. 2, including standing members 28 with inclined surfaces 30 and finger-repelling edges 32 and having pointed members 34 as finger-repelling means between standing members 28. Extender portion 40 has pointed members 34 in spaced arrangement thereon to serve as finger-repelling means. Extender portion 40, the portion of top surface 26 between standing members 28, either of inclined surfaces 30 taken alone and finger-repelling edges 32 together form an ineffective area of the upper surface of actuator members 16. Inclined surfaces 30 taken together form an effective area of actuator member 16; when a finger of adult width and sufficient length contacts both of inclined surfaces 30, a downward actuating pressure may effectively be applied to actuator member 16.

Actuator members 16 are located in a recess space 44 defined in the overcap structures 36. Overcap structures 36 have an outer wall 46, each including an end surface 48 and a lateral surface 50 defining an opening 52 in the overcap structure which provides access to recess space 44. In the preferred embodiments shown in FIGS. 1 and 3–8, opening 52 and recess space 44 are equal to a second predetermined width which is greater than the distance between standing members 28 (as shown in FIGS. 1–5) but less than the typical width of two adjacent fingers of a young child. By being so designed, the devices of this invention cannot readily be actuated by a child using two adjacent fingers.

In the embodiments of FIGS. 1 and 3–5, extender portion 40 has a predetermined length between hinge 38 and operational portion 42 which is greater than the typical thumb length of a young child. This feature prevents actuation by a child who may have a thumb wide enough to bridge the inclined surfaces 30 since a short thumb could not reach operational portion 42. For added safety, extender portion 40 may have a length also greater than the typical length of the longest fingers of a young child. Thus, the finger of a potential operator must be both wide enough and long enough if one is to be successful in actuating the valve.

Figure 5:
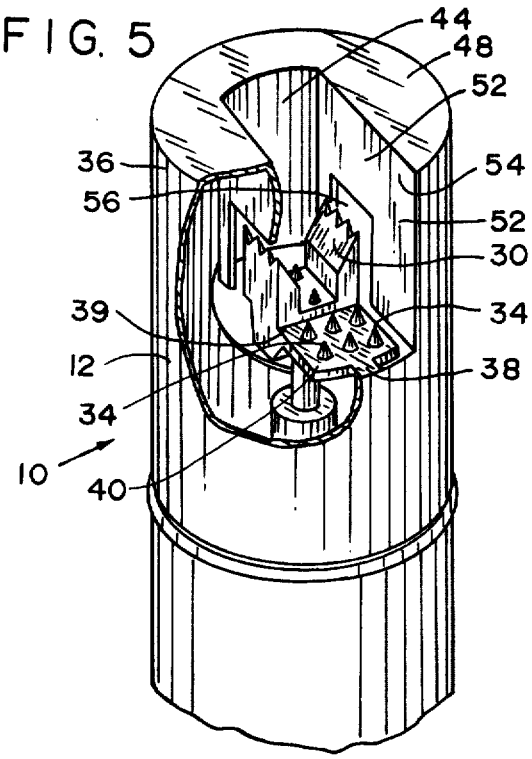
FIG. 5 is a partially cutaway perspective view of the device of this invention including certain preferred features.

In the embodiment shown in FIG. 5, the internal lateral walls 54 forming recess space 44 include void areas 56 immediately adjacent the standing members 28 such that it is impossible to push actuator member 16 laterally into walls 54 by application of pressure to either of the inclined surfaces 30, which could guide it downwardly to actuate the valve. With void areas 56 there will be no contact between lateral walls 54 and standing member 28.

Figure 2:
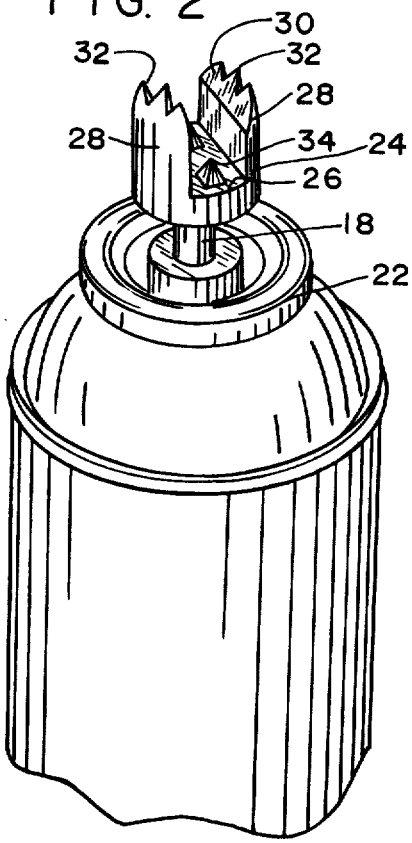
FIG. 2 is an enlarged fragmentary perspective view of another embodiment of this invention, including an actuator button according to this invention.
Figure 3:
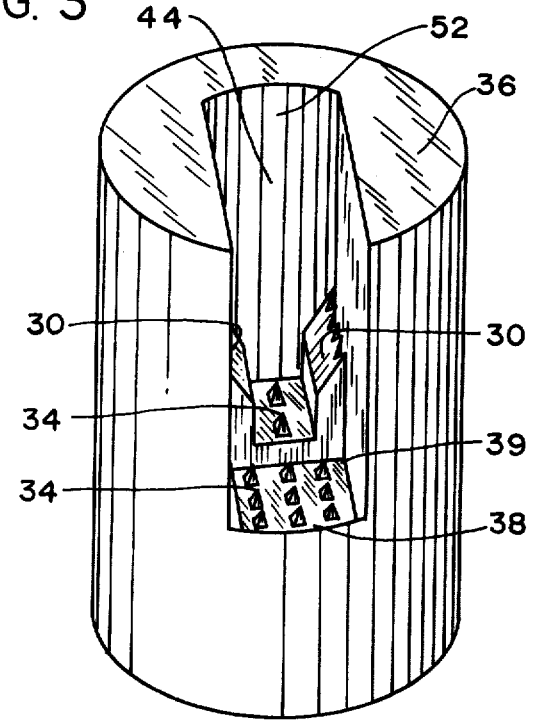
FIG. 3 is an enlarged perspective view of an actuator-overcap according to this invention.
Figure 4:
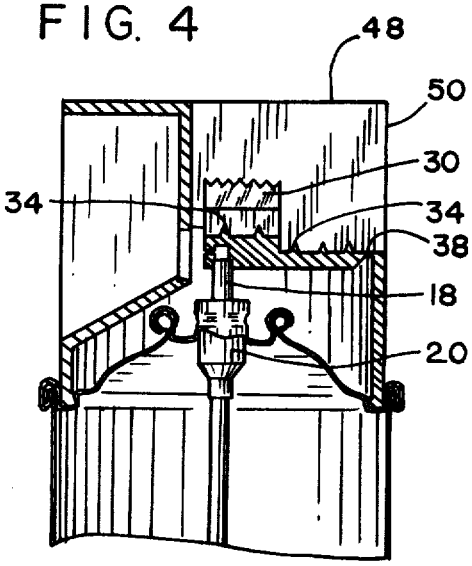
FIG. 4 is a side sectional view of the device of FIG. 3.

In the embodiments shown in FIGS. 1 and 5 hinge 38 forms a narrow connection between actuator member 16 and overcap structure 36. With a hinge of this type a downward pressure applied to one of the inclined surfaces 30 would tend to twist actuator member 16 about an axis running from hinge 38 lengthwise along actuator member 16 to allow tilting of the actuator member, as opposed to downward movement thereof, which, of course, could actuate the valve. This is yet another preferred feature preventing actuating depression of the actuator member by a child of tender years.

Figure 6:
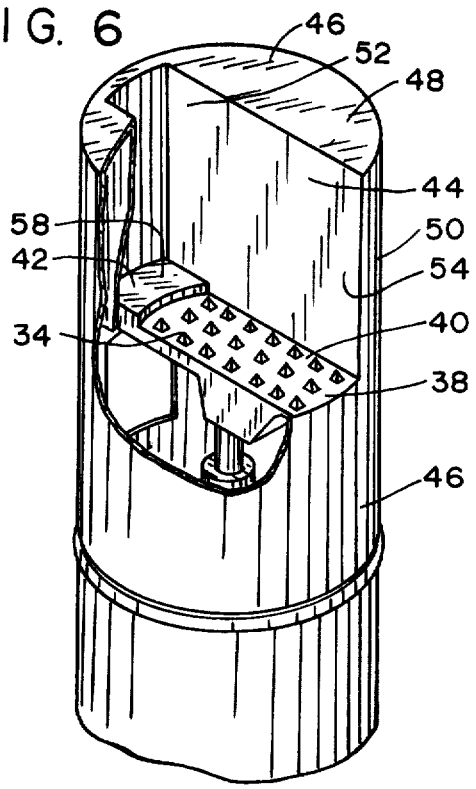
FIG. 6 is a partially cutaway perspective view of another embodiment of this invention.
Figure 7:
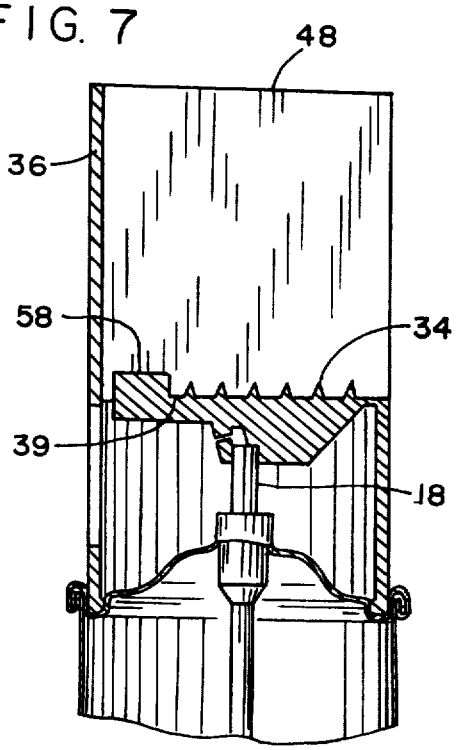
FIG. 7 is a side sectional view of the device of FIG. 6.
Figure 8:
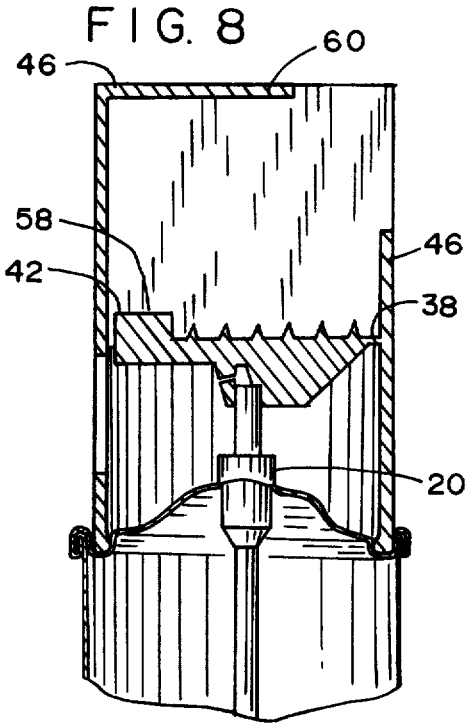
FIG. 8 is a side sectional view of an alternative embodiment of the device of FIG. 6.

The embodiments illustrated in FIGS. 6–8 include an actuator member having an extender portion 40, like that in the embodiments in FIGS. 1 and 3–5, and an operational portion 58 which is a generally flat surface. Operational portion 58 is elevated above the level of extender portion 40 to provide ready access to an adult finger. Extender portion 40 has a predetermined length which is greater than the typical finger length of a child of tender years. Further, the distance from opening 52 in overcap structure 36 to operational portion 58 is greater than the finger length of a child of tender years. Only the finger-repelling pointed members 34 of extender portions 40 can be reached by a child's finger, thereby making comfortable valve actuation virtually impossible for such children. Operational portion 58 is non-depressible to a child's finger, being inaccessible to it. Such extender portion, therefore, is an ineffective area of the upper surface of actuator member 16. However, an adult could readily reach operational portion 58, which is an effective area for actuation of the valve.

In the embodiment of FIG. 8, opening 52 in overcap structure 36 is diminished in area by the inclusion of the overhang 60. If an overhang 60 is included, the height of the overcap structure can be reduced since there is no direct downward access from directly above operational portion 58, but rather a diagonal access of greater length.

The overcap structures and actuator members of this invention are preferably molded in plastic as is common with aerosol valve overcaps and actuators. Finger-repelling means of a wide variety may readily be molded into the actuator members to obtain the desired effect in making a child-safe aerosol device. Finger-repelling means other than those illustrated may be utilized in designing and making child-safe aerosol actuators in accordance with this invention.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

We claim:

1. A device for use with pressurized dispensers and adapted to prevent valve actuation by finger pressure of human fingers of less than predetermined dimensions while allowing actuation by fingers of greater than said predetermined dimensions, comprising an actuator member having an exposed surface, said surface having effective and ineffective areas, said effective area non-depressible by a finger of less than said predetermined dimensions, and said ineffective areas having substantially sharp finger-repelling means thereon which would cause substantial discomfort to the human finger when applying valve-actuating pressure thereto, whereby the finger pressure required for valve actuation is effectively applied only to said effective area.

2. The device of claim 1 adapted to prevent valve actuation by a finger of less than a first predetermined width, wherein said actuator member comprises:

a base having a top surface;

two standing members fixed on said top surface and spaced apart by said predetermined width, said members having facing, substantially mirror-image inclined surfaces terminating upwardly in finger-repelling edges; and said finger-repelling means being arranged on and affixed to said top surface, whereby the finger pressure required for actuation cannot comfortably be applied without finger contact with both of said inclined surfaces.

3. The device of claim 2 wherein said finger-repelling means comprises a multiplicity of pointed members in closely spaced arrangement.

4. The device of claim 2 wherein said finger-repelling edges comprise toothed edges.

5. The device of claim 4 wherein said finger-repelling means comprises a multiplicity of pointed members in closely spaced arrangement.

6. The device of claim 2 further comprising an overcap structure defining a recess space and having an outer wall defining an opening to said recess space, said base being hinged to said structure, said base and said standing members being contained within said recess space.

7. The device of claim 6 wherein the width of said recess space is equal to a second predetermined width, greater than said first predetermined width but less than the typical combined width of two adjacent fingers of a young child.

8. The device of claim 6 wherein said recess space is defined by lateral walls, said lateral walls having void areas adjacent said standing members whereby there is no contact between said lateral walls and said standing members when said standing members are moved laterally.

9. The device of claim 8 wherein said actuator member is twistable about an axis running from the hinge lengthwise along said actuator member to allow tilting of said actuator member, thereby to prevent actuating depression when only one of said two standing members is depressed.

10. The device of claim 8 wherein said finger-repelling means comprises a multiplicity of pointed members in closely spaced arrangement.

11. The device of claim 8 wherein said finger-repelling edges comprise toothed edges.

12. The device of claim 11 wherein said finger-repelling means comprises a multiplicity of pointed members in closely spaced arrangement.

13. The device of claim 6 wherein said base is hinged to said overcap structure near the outer periphery thereof and wherein said base comprises an extender portion adjacent said hinge and an operational portion remote from said hinge, said standing members being affixed to said base only in said operational portion, said extender portion having a predetermined length greater than the typical thumb length of a young child.

14. The device of claim 13 wherein said recess space is defined by lateral walls, said lateral walls having void areas adjacent said standing members whereby there is no contact between said lateral walls and said standing members when said standing members are moved laterally.

15. The device of claim 13 wherein said predetermined length of said extender portion is also greater than the typical finger length of a young child.

16. The device of claim 15 wherein said recess space is defined by lateral walls, said lateral walls having void areas adjacent said standing members whereby there is no contact between said lateral walls and said standing members when said standing members are moved laterally.

17. The device of claim 14 wherein said actuator member is twistable about an axis running from the hinge lengthwise along said actuator member to allow tilting of said actuator member, thereby to prevent actuating depression when only one of said two standing members is depressed.

18. The device of claim 17 wherein the width of said recess space is equal to a second predetermined width, greater than said first predetermined width but less than the typical combined width of two adjacent fingers of a young child.

19. The device of claim 18 wherein said finger-repelling means comprises a multiplicity of pointed members in closely spaced arrangement.

20. The device of claim 18 wherein said finger-repelling edges comprise toothed edges.

21. The device of claim 20 wherein said finger-repelling means comprises a multiplicity of pointed members in closely spaced arrangement.

22. The device of claim 1 adapted to prevent actuation by fingers of less than a predetermined length, including: an overcap structure defining a recess space and having an outer wall defining an opening therein providing access to said recess space, said actuator member being hinged to said structure near said outer wall and having an extender portion adjacent said hinge and an operational portion remote from said hinge, said extender portion having said predetermined length and forming said ineffective area and said operational portion forming said effective area.

23. The device of claim 22 wherein said finger-repelling means comprises a multiplicity of pointed members in closely spaced arrangement.

24. The device of claim 22 wherein said operational portion is elevated with respect to said extender portion.

25. The device of claim 24 wherein said finger-repelling means comprises a multiplicity of pointed members in closely spaced arrangement.

26. The device of claim 22 wherein the distance from said opening to said operational portion is at least said predetermined length.

27. The device of claim 26 wherein said finger-repelling means comprises a multiplicity of pointed members in closely spaced arrangement.

* * * * *